US008341845B2

(12) United States Patent
Janny et al.

(10) Patent No.: US 8,341,845 B2
(45) Date of Patent: Jan. 1, 2013

(54) HAIR-CLIPPING DEVICE

(75) Inventors: Michael Janny, Klagenfurt (AT); Rene Wadsack, Klagenfurt (AT); Wolfgang Obermann, Klagenfurt (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 647 days.

(21) Appl. No.: 12/305,106

(22) PCT Filed: Jun. 15, 2007

(86) PCT No.: PCT/IB2007/052280

§ 371 (c)(1),
(2), (4) Date: Dec. 16, 2008

(87) PCT Pub. No.: WO2007/148270

PCT Pub. Date: Dec. 27, 2007

(65) Prior Publication Data

US 2009/0265938 A1 Oct. 29, 2009

(30) Foreign Application Priority Data

Jun. 19, 2006 (EP) ..... 06115636

(51) Int. Cl.
*B26B 19/06* (2006.01)

(52) U.S. Cl. ..... 30/34.1; 30/29.5; 30/43.92

(58) Field of Classification Search ..... 30/34.1, 30/43.92, 210, 216, 29.5; D28/49, 51, 53
See application file for complete search history.

(56) References Cited

U.S. PATENT DOCUMENTS

| | | | | |
|---|---|---|---|---|
| 2,098,849 | A | 11/1937 | Amsler | |
| 2,127,881 | A * | 8/1938 | Morris | 30/32 |
| 2,253,737 | A | 8/1941 | Testi | |
| 4,085,503 | A | 4/1978 | Beck et al. | |
| 4,393,585 | A | 7/1983 | Nagelkerke | |
| 4,521,962 | A * | 6/1985 | Van Natta | 30/34.1 |
| 4,916,814 | A * | 4/1990 | Althaus | 30/40.2 |
| 4,980,973 | A * | 1/1991 | Lee et al. | 30/34.1 |
| 5,054,199 | A * | 10/1991 | Ogawa et al. | 30/34.1 |
| 5,701,673 | A * | 12/1997 | Ullmann et al. | 30/34.1 |
| 6,604,287 | B2 * | 8/2003 | Melton et al. | 30/123 |
| 7,111,398 | B1 * | 9/2006 | Park | 30/30 |
| 7,503,117 | B2 * | 3/2009 | Wetzel et al. | 30/34.1 |
| 7,536,787 | B2 * | 5/2009 | Blaustein et al. | 30/34.05 |
| 2008/0216329 | A1 * | 9/2008 | Leventhal | 30/527 |
| 2010/0011587 | A1 * | 1/2010 | Obermann et al. | 30/34.2 |
| 2011/0094110 | A1 * | 4/2011 | Obermann | 30/223 |

FOREIGN PATENT DOCUMENTS

| | | | |
|---|---|---|---|
| DE | 4039681 | A1 | 7/1991 |
| EP | 1366870 | A1 | 12/2003 |
| JP | 2005237936 | A | 9/2005 |
| WO | 2005002806 | A1 | 1/2005 |

* cited by examiner

*Primary Examiner* — Hwei C Payer

(57) ABSTRACT

A hair-clipping device includes a main body, a main hair-clipping unite supported by the main body, and additional hair-clipping unit having an active hair-clipping portion extending over a longitudinal dimension and being supported by a supporting unit. The supporting unit, at least in one predetermined working position of the active hair-clipping portion, extends only over a part of the longitudinal dimension. Thereby at least one free end portion of the active hair-clipping portion exists that can, for example, be easily inserted into the nose to remove nose hair.

8 Claims, 10 Drawing Sheets

HAIR-CLIPPING DEVICE

FIELD OF THE INVENTION

The invention is directed to a hair-clipping device comprising: a main body, main hair-clipping means supported by the main body, and additional hair-clipping means having an active hair-clipping portion extending over a longitudinal dimension and being supported by supporting means.

BACKGROUND OF THE INVENTION

A hair-clipping device of the type mentioned above is known from U.S. Pat. No. 4,393,585 which is directed to a dry shaving apparatus. Besides main hair clipping means in the form of a stationary shear foil interacting with a driven cutter element this shaving apparatus comprises a plurality of additional hair-clipping means. At least one of these additional hair-clipping means are formed by a hair trimmer of relative short length which can be used for trimming facial hairs which are located in constricted areas or in places which are not readily accessible to a full-length hair trimmer, for example, the moustache, nose, ears and eyebrows. Each of these hair trimmers consists of a pair of cooperating toothed cutters of which one reciprocates and the other is stationary in operation, wherein these cutters form an active hair-clipping portion extending over a longitudinal dimension. The cutters are supported by a plate shaped support extending over the longitudinal dimension and being adapted to move the cutters between a retracted and an extended position. A disadvantage of the dry shaving apparatus known from U.S. Pat. No. 4,393,585 is that its hair trimmers cannot easily be used in some areas of the face, particularly not in cavities like nose or ear cavities.

It is the object of the invention to further develop the hair-clipping devices of the type mentioned at the beginning such that hair can be easily removed also from cavities, particularly from the nose.

SUMMARY OF THE INVENTION

According to the present invention, the above object is solved by providing a hair-clipping device according to claim 1. Preferred embodiments and further developments are outlined in the dependant claims.

In accordance with the invention there is provided a hair-clipping device of the type mentioned at the beginning, wherein the supporting means at least in one predetermined working position of the active hair-clipping portion do not extend or do extend only over a part of the longitudinal dimension. By this solution the active hair-clipping portion comprises at least one free end portion which can, for example, easily be inserted into the nose to remove nose hair. With preferred embodiments the hair-clipping device in accordance with the invention is an electric shaver comprising a nose hair trimmer. Preferably, the additional hair-clipping means can also be used, for example, as a usual hair trimmer.

With preferred embodiments the active hair-clipping portion and the supporting means at least in the predetermined working position comprise an L-configuration. In this case the supporting means form one leg and the active hair-clipping portion extends at least in sections over the other leg of the L.

Alternatively it is, for example, possible that the active hair-clipping portion and the supporting means at least in the predetermined working position comprise a T-configuration.

In this case the supporting means preferably form the base of the T and the active hair-clipping portion extends at least in sections over the bar of the T. With this solution a symmetric arrangement can be obtained. This is for example useful, if the additional hair-clipping means are used as a conventional hair-trimmer, since torques are avoided thereby.

It is preferred for all embodiments that the supporting means comprise transmission means for coupling the additional hair-clipping means at least in the predetermined working position to a drive accommodated in the main body. For example, the transmission means can comprise a drive shaft interacting with an eccentricity.

In accordance with a preferred further development at least the active hair-clipping portion is movable between the at least one working position and a storage position. In the storage position the additional hair-clipping means can be accommodated fully or in part within the main body.

In this context it is possible that moving the active hair-clipping portion between the at least one working position and the storage position comprises a pivoting movement.

Alternatively or additional it is possible that moving the active hair-clipping portion between the at least one working position and the storage position comprises a sliding movement.

With highly preferred embodiments of the hair-clipping device in accordance with the invention the additional hair-clipping means comprise: a stationary cutter member having an outer surface, a chamber bounded by an inner surface, and at least one hair-catching opening extending from the outer surface to the inner surface; at least one movable cutter member comprising at least one cutting edge, the movable cutter member fitting in the chamber with a free, close fit; wherein the drive is coupled to the movable cutter member for driving movement of the movable cutter member relative to the stationary cutter member; and wherein the at least one movable cutter member includes a carrier oriented in longitudinal direction of the movable cutter member, the cutting edges being provided on cutters projecting radially from the carrier. Because the or each movable cutter member includes a carrier extending in longitudinal direction, along at least a number of the cutters of the movable cutter member, and the cutting edges are provided on the cutters projecting radially from the carrier, the cutter member can be manufactured to tight tolerances easily and is radially stiff, so that maintenance of the close, free fit in operation is reliably ensured. The movable cutter member accommodates to non-straightness of the chamber relatively easily, because the longitudinally oriented carrier from which the cutters project towards the inner surface bounding the chamber has a cross-section that is considerably smaller than the cross-section of the chamber.

In this connection it is further preferred that the at least one movable cutter member includes a rod section with recesses, the cutting edges being integrally formed with the carrier by edges of the recesses. Integrally forming the cutting edges in such a way is more reasonable than using a multi part arrangement.

Furthermore, it is preferred that the at least one movable cutter member has a largest cross-sectional size smaller than 10 mm. If, for example, the cross sectional size of the stationary cutter member is less than 5 mm, the free end(s) of the additional hair-clipping means can be easily inserted into the nose.

As regards the chamber, it is preferred that this chamber has a circular cross-section. However, also other configurations are possible, for example a rectangular cross-section.

The at least one movable cutting member preferably fits in the chamber with a clearance smaller than 50 μm. For instance to ensure that the clearance is between 10 and 40 μm, for a chamber or chamber and a movable cutter member having a nominal diameter of 3 mm, the movable cutter member could for instance be worked to ISO tolerance H8 and the chamber could for example be worked to ISO tolerance f7. To achieve the same tolerance range on the clearance for a chamber and a movable cutter member having a nominal diameter of 6 mm, the movable cutter member would for instance have to be worked to ISO tolerances H7 and, respectively, f6 (if the same classes are used with respect to the offset from the nominal size).

With some embodiments the stationary cutter member comprises at least one row of ears radially projecting from the outer surface, transitions from the outer surface to the ears being straight or curved with a center of curvature on the outside of the outer surface. Such ears are particularly effective for stretching the skin, if the additional hair-clipping means are used for shaving relative smooth skin portions.

It is also possible that there is provided a row of ears radially projecting from the outer surface and extending along the stationary cutter member, the ears of said row being located at least partially within an angular range in circumferential sense that is occupied by the at least one hair-catching opening.

With some embodiments the chamber contains at least two of said movable cutter members arranged in succession in longitudinal direction of the chamber. In many cases it is cheaper to make a plurality of shorter moveable cutter members than one single long moveable cutting member.

In this context it is preferred that the carriers of said at least two of said movable cutter members are linked for transferring the movement of one of said at least two movable cutter members to another one of said at least two movable cutter members. Thereby it is sufficient to directly drive only one or at least not all of the moveable cutting members.

With some embodiments the at least one hair-catching opening has a length in longitudinal direction of the cutter members that covers a plurality of the cutters.

For example, the at least one hair-catching opening of the stationary cutter member can cover at least 80% of the length of that stationary cutter member.

It is also possible that the at least one hair-catching opening of the stationary cutter member is in the form of a slit extending in the longitudinal direction of the movable cutter member and having a plurality of bays projecting circumferentially from the slit, the cutting edges of the stationary cutter member extending along said bays.

It is also possible that the main hair-clipping means comprise: at least one stationary cutter member having an outer surface, a chamber bounded by an inner surface, and at least one hair-catching opening extending from the outer surface to the inner surface; at least one movable cutter member comprising at least one cutting edge, the movable cutter member fitting in the chamber with a free, close fit; wherein the drive is coupled to the movable cutter member for driving movement of the movable cutter member relative to the stationary cutter member; wherein the at least one movable cutter member includes a carrier oriented in longitudinal direction of the movable cutter member, the cutting edges being provided on cutters projecting radially from the carrier. With this solution the main and the additional hair-clipping means can be of the same type, wherein the dimensions of the main hair-clipping device can be larger than the dimension of the additional hair-clipping means. Furthermore, it is possible particularly for the main hair-clipping means that more than one stationary cutter member is provided. Furthermore, it should be clear that the preferred embodiments of the hair-clipping means discussed above in connection with the additional hair-clipping means can also be used in connection with the main hair-clipping means, and the respective combination shall be deemed to be disclosed herewith. However, the invention is not limited to main hair-clipping means of this type, but other arrangements comprising reciprocating cutter elements (for example in connection with one or more shearing foils) and/or rotating cutter elements are also within the scope of the invention.

These and other aspects of the invention will be apparent from and elucidated with reference to the embodiments described hereinafter.

DESCRIPTION OF PREFERRED EMBODIMENTS

Figure 1:
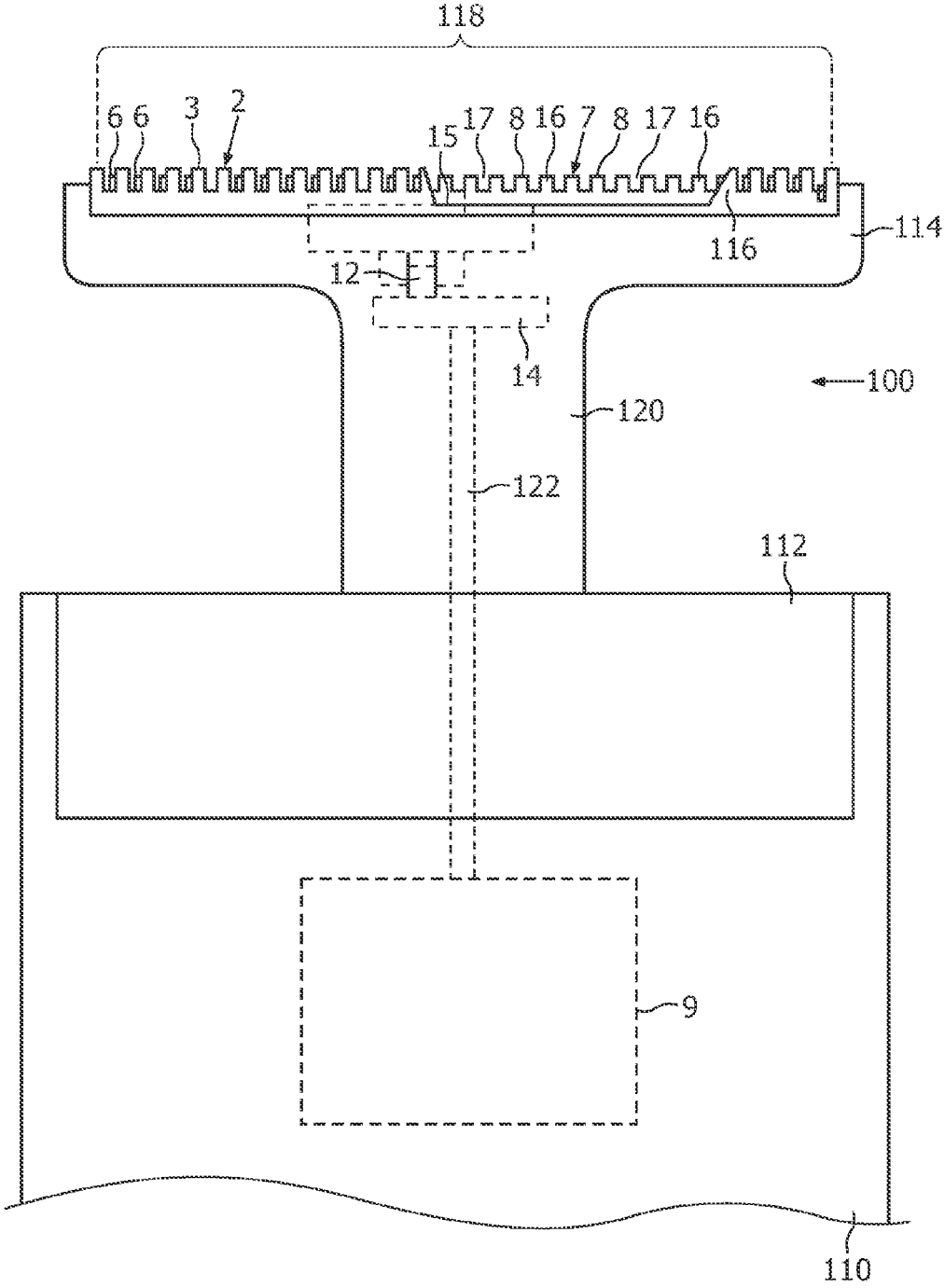
FIG. 1 is a schematic representation of an example of a hair-clipping device according to the invention comprising a first embodiment of the additional hair-clipping means.

In the following description equal or similar reference numerals denote equal or similar parts. Furthermore, for the sake of clarity, in several instances, not all corresponding parts in the drawings are designated by reference numerals.

Figure 3:
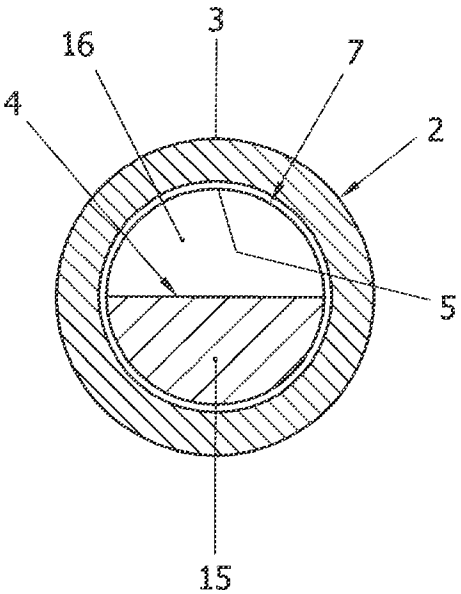
FIG. 3 is an enlarged cross-sectional view along the line II-II in FIG. 2.
Figure 2:
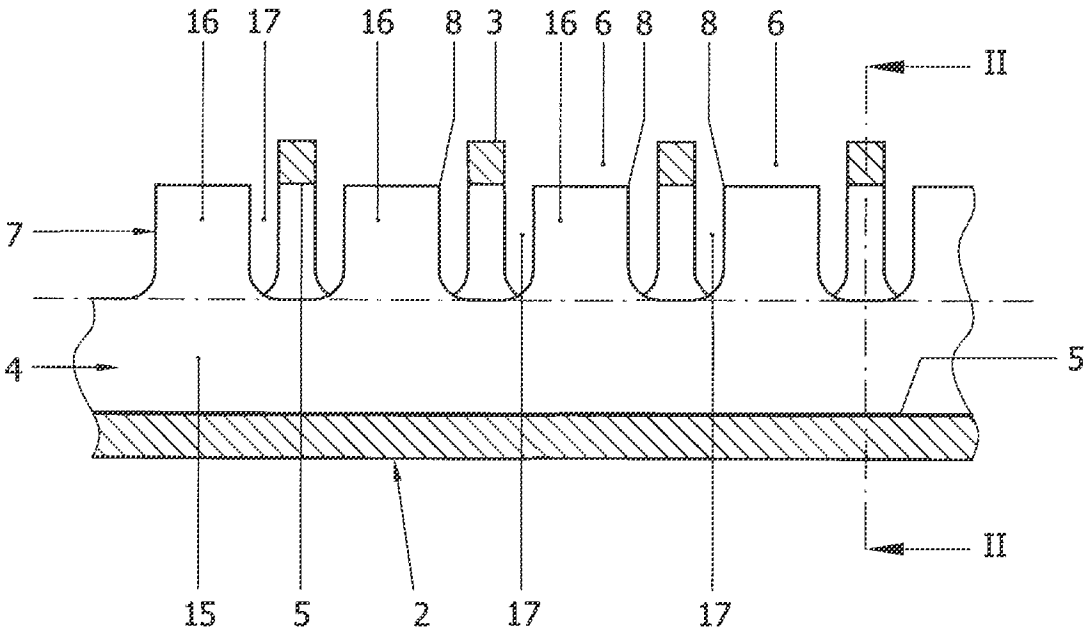
FIG. 2 is an enlarged cross-sectional view along a plane in longitudinal direction of the cutter members of portions of the stationary and movable cutter members.

In FIGS. 1-3 an example of a hair-clipping device 100 according to the invention is shown. FIG. 1 schematically shows the upper part of a hair-clipping device 100 in the form of a shaver which comprises a main body 110 and main hair-clipping means 112 supported by the main body 110. In FIG. 1 the main hair-clipping means are indicated as comprising a shearing foil, but this is only one possibility. In general all suitable hair-clipping means known to the person skilled in the art can be used. Besides the main hair-clipping means 112 the hair-clipping device 110 comprises additional hair-clipping means 114 that are shown in a working position. If the main hair-clipping device is to be used, the additional hair-clipping means 114 can be brought into a storage position in which they are accommodated fully or in part in the main body 110. The additional hair-clipping means 114 comprise an active hair-clipping portion 116 extending over a longitudinal dimension 118. Furthermore, the additional hair-clipping means 114 are supported by supporting means 120 which extend only over a part of the longitudinal dimension 118. Thereby a T-configuration is provided which leads to two free end portions of the additional hair-clipping means 114. These free end portions can be easily inserted, for example, into the nose to remove nose hair. It is, however, also possible to use the additional hair-clipping means 114 as a shaver for close shaving, as a conventional trimmer for cutting and, as far as desired, shaving hair along the boundaries of for instance a beard, a moustache, side-whiskers or eye-brows or along the bikini line. The additional hair-clipping means 114 comprise a stationary cutter member 2. The stationary cutter member 2 has an outer surface 3 for contacting skin to be shaved and a hole or chamber 4 bounded by an inner surface 5 parallel to the outer surface 3. The chamber 4 is profile-shaped. Although in the present example the outer surface is designed for shaving the skin to be shaved smoothly, the outer surface may also be designed and positioned for contacting the skin to be shaved in such a manner that, during the shaving, the hairs are cut off at a predetermined, or at least controlled length, such as when using a hair-clipper. Hair-catching openings 6 extend from the outer surface 3 to the inner surface 5 and are arranged in a row in longitudinal direction of the stationary cutter member 2. A movable cutter member 7 fits in the chamber 4 with a free, close fit and has a row of cutting edges 8, the row being oriented in the same direction as the row of hair-catching openings 6 and as the movable cutting member 7. A drive is provided by transmission means 122 in the form of a drive shaft accommodated in the supporting means 120 and connected to a motor 9 and to an excenter disk 14, wherein a slot 12 in which a knob of the excenter disk 14 is engaged is coupled to the movable cutter member 7 for driving movement of the movable cutter member 7 relative to the stationary cutter member 2. The free fit of the movable cutting member 7 in the chamber 4 helps to avoid radial pressure caused by pre-stress, such as occurs for example when a movable cutter member is resiliently pressed against a stationary cutter member by spring force. Accordingly, additional normal pressure and associated friction added by tightness between the chamber 4 and the movable cutting member are also avoided. The close fit ensures reliable cutting of hairs that are caught between the cutter members 2, 7. The movable cutter member 7 includes a continuous carrier 15 oriented in longitudinal direction of the movable cutter member 7. The cutting edges 8 are provided on cutters 16 projecting radially from the carrier 15. The cutter member 7 can be manufactured to tight tolerances easily and is radially stiff in the sense that dynamic and static loads that are exerted onto the movable cutter member 7 during use cause very little changes in the radial dimensions of the cutter member 7. For instance, all longitudinal loads, such as loads caused by oscillating movement, friction forces and shear forces exerted onto the hairs during cutting, cause very little deformation of the axially extending carrier 15 which is very stiff longitudinally. The cutters 16 each only have to transfer loads that are directly exerted thereon and are not involved in the transfer of loads exerted by or onto other ones of the cutters 16 and the loads that are exerted onto the cutters 16 during use have only minimal effect on the dimensions of the cutters 16 in radial directions. Thus, maintenance of the close, free fit in operation is reliably ensured. Nevertheless, non-straightness of the chamber 4, which may for instance be caused by manufacturing tolerances or by loads exerted onto the stationary cutter member 2 during shaving, causes only relatively small loads exerted by the chamber 4 onto the movable cutter member 7 and, accordingly, relatively little friction between the movable cutter member 7 and the inner surface 5 of the chamber 4, because the longitudinally oriented carrier 15 from which the cutters 16 project towards the inner surface 5 bounding the chamber 4 have a cross-section that is considerably smaller than the cross-section of the chamber 4 and therefore bends relatively easily in planes in its longitudinal direction. According to the present example, the movable cutter member 7 includes a rod section with recesses 17 and the carrier 15 is formed by a portion of the rod that is continuous in longitudinal direction of the cutter member 7. The rod section is preferably solid for large axial stiffness by small bending stiffness, as in this example, but may also be hollow. The cutting edges 8 are integrally formed with the carrier 15 by edges of the recesses 17 in the rod. Thus, the movable cutter member 7 can be manufactured in a simple manner and with tight tolerances, for example by cylindrical grinding and grinding the recesses in the rod. Furthermore, the integral construction reduces the risk of damage due to failure of connections between the carrier 15 and the cutters 16. Although in the present example the carrier 15 is continuous in longitudinal direction over the length or almost the length of the stationary cutter member 2 as well, it is also possible to provide two or more movable cutter members each continuous along the cutters of its own carrier. The plurality of movable cutter members may be separately movable and may also be separately drivable.

Figure 13:
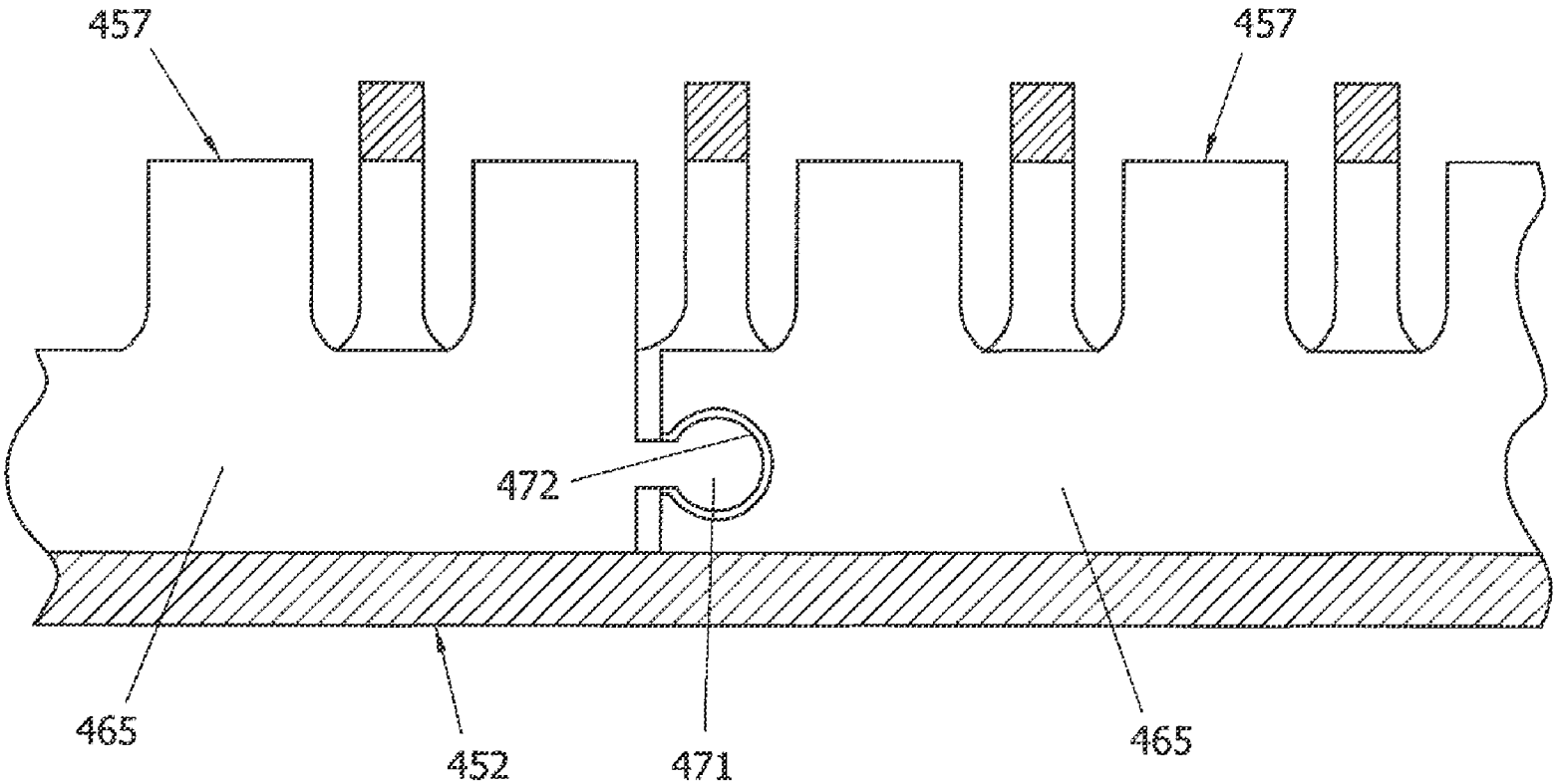
FIG. 13 is an enlarged cross-sectional view along a plane in longitudinal direction of the cutter members of portions of stationary and movable cutter members of yet another example of additional hair-clipping means.

As is shown in FIG. 13, all or some of the plurality of movable cutter members 457 may have its carrier 465 linked to the carrier 465 or carriers of one or more neighboring movable cutter members 457 to form one or more cutter member chains that are drivable in a simple manner by driving only one or a few of the cutter members, the other cutter members being entrained by the driven cutter members to which they are linked. According to the present example, the carriers 465 are linked by interlocking coupling members 471, 472 that allow a slight pivotal movement of successive linked carriers relative to each other. During assembly, the mutually engaged coupling members 471, 472 are slid into engagement. Once arranged in the chamber, mutual movement in lateral direction that would allow the coupling members 471, 472 to disengage is prevented by the internal surfaces of the chamber into which the movable cutting members 457 fit with a close, free fit. Because two or more carriers 465 are arranged in succession in longitudinal direction in the same chamber of a stationary cutter 452, the individual carriers 465 may be relatively short, which further facilitates accommodation of the cutter members 457 to deviations from the nominal shape, such as deviations within a tolerance range, of the chamber.

Referring back to FIGS. 1 to 3, the movable cutter member 7 preferably has a largest cross-sectional size smaller than 10 mm and more preferably a largest cross-sectional size smaller than 5 mm or a largest cross-sectional size of 3 mm or less. By providing that the movable cutter member 7 and the chamber 4 have small diameters, tight tolerances of the clearance between the movable cutter member 7 and the inner surfaces 5 of the chamber can be ensured more easily. For instance to ensure that the clearance is between 10 and 40 μm, for a chamber 4 and a movable cutter member 7 having a nominal diameter of 3 mm, the movable cutter member 7 could for instance be worked to ISO tolerance H8 and the chamber could for example be worked to ISO tolerance f7. To achieve the same tolerance range on the clearance for a chamber 4 and a movable cutter member 7 having a nominal diameter of 6 mm, the movable cutter member 7 would for instance have to be worked to ISO tolerances H7 and, respectively, f6 (if the same classes are used with respect to the offset from the nominal size). This is one tolerance class higher, which requires more precise manufacturing and therefore entails additional costs. Moreover, with the cross-sectional size of the movable cutter member 7 and of the chamber 4, the bending stiffness of the movable cutter member 7 and of the chamber 4 increases, causing increased friction if the cutter member 7 and/or the chamber 4 are not straight. Another advantage of a small cross-sectional size of the movable cutter member 7 and of the chamber 4 is, that the wall portion of the stationary cutter member between successive hair catching openings 6 may be very slender, so that the open hair-catching area may be very large in relation to the total shaving surface and the wall thickness between the shaving surface 3 and the inner surface 5 in the chamber 4 may be very thin, which in turn is advantageous for achieving a close shave. For reliable cutting of hairs of all sorts, the movable cutting member 7 preferably fits in the chamber 4 with a clearance smaller than 50 μm and more preferably at most about 30 or 40 μm. For ease of manufacturing, it is furthermore advantageous if the chamber 4 has a circular cross-section, this facilitates working the chamber 4 and the movable cutter member 7 to be fitted therein to corresponding sizes and shapes, with tight tolerances. However, instead of the profile of the chamber having a circular cross-section, the profile may also have another shape, such as elliptical, square or triangular, the cutter members being shaped accordingly.

Figure 4:
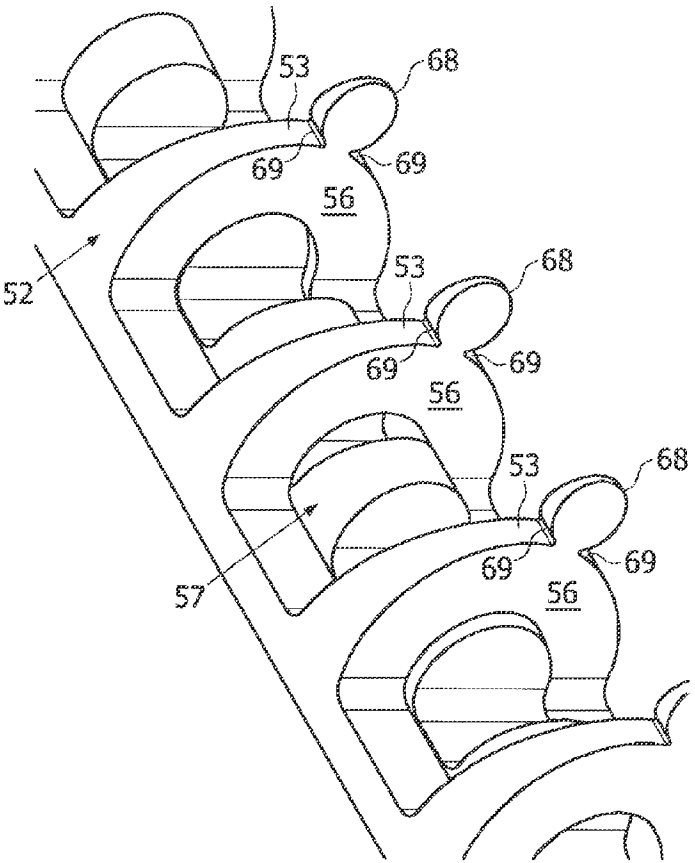
FIG. 4 is an enlarged perspective view of portions of the stationary and movable cutter members of another example of the additional hair-clipping means.

In FIG. 4, portions of a stationary cutting member 52 and a movable cutting member 57 of another example of additional hair-clipping means are shown. The stationary cutting member 52 is provided with a row of ears 68 radially projecting from the shaving surface 53. Transitions 69 from the shaving surface 53 to the ears 68 are curved with a center of curvature on the outside of the shaving surface 53. Thus, the hair-catching ears 68 are particularly effective for stretching the skin, when the ears 68 are passed over the skin preceding the shaving surface, because the skin is freely tensioned in an area between the ears 68 and the shaving surface 53, where the stationary cutter member 52 does not contact the skin and therefore exerts no frictional force onto the skin in the direction of movement of the ears 68. To at least some extent, this effect may also be achieved if the transitions from the shaving surface to the ears are straight. The straight transitions are preferably flat to obtain evenly distributed contact pressure, but also another shape may be provided.

According to the present example, in circumferential sense, the ears 68 are disposed at least partially within the angular range occupied by the hair-catching openings 56 and preferably about 15-19° off-center in circumferential sense with respect to the hair-catching openings 56. This allows to use the ears 68, firstly, as skin stretchers if the hair-clipping device is passed over the skin with the ears 68 leading the portion of the shaving surface 53 that are in contact with the skin and, secondly, as spacers for keeping the movable cutter 57 further spaced from the skin if the hair-clipping device is passed over the skin with the ears 68 pointing to the skin approximately perpendicularly to the skin.

Figure 5:
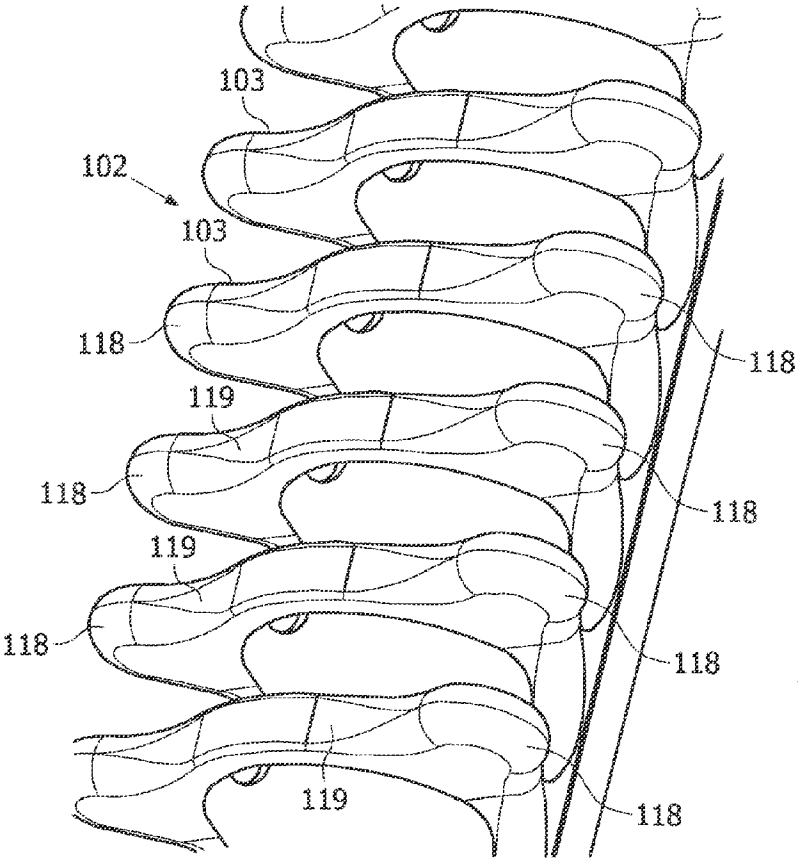
FIG. 5 is an enlarged perspective view of portions of the stationary and movable cutter members of yet another example of the additional hair-clipping means.

In FIG. 5, portions of a stationary cutting member 102 of yet another example of additional hair-clipping means is shown. In this stationary cutting member 102, two rows of ears 118 project radially from the shaving surface 103 on opposite sides of a central portion of the shaving surface 103. Transitions 119 from the shaving surface 103 to the ears 118 are also curved with a center of curvature on the outside of the shaving surface 103. The two rows of ears allow the skin stretching effect to be achieved during passage of the stationary cutting member 102 over the skin in two opposite general directions.

Figure 6:
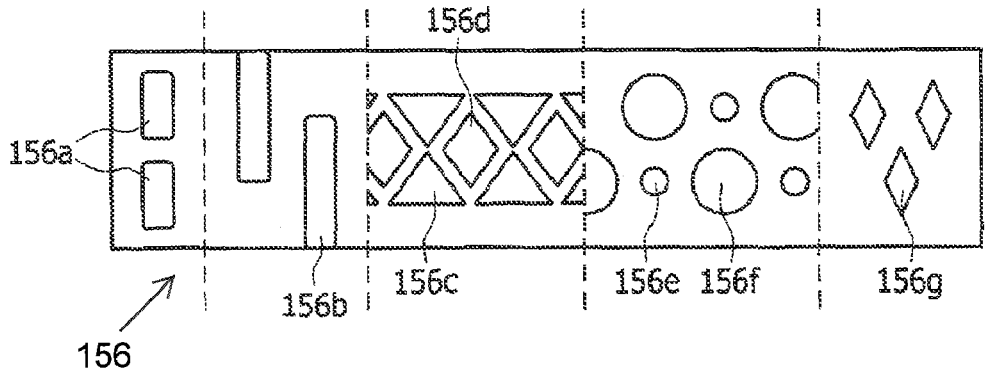
FIG. 6 is an enlarged top plan view of a number of alternative elaborations of stationary cutter members.
Figure 7:
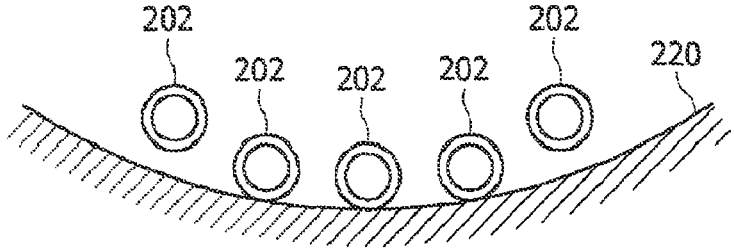
FIG. 7 is an enlarged side view of a configuration of cutter assemblies of main hair-clipping means.
Figure 8:
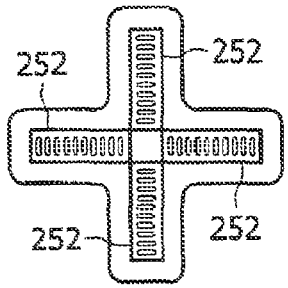
FIGS. 8 and 9 are top plan views of two further examples of configurations of cutter assemblies of main hair-clipping means.

Depending on the envisaged main use of the additional hair-clipping means, the hair-catching openings 156 can be provided in many forms and patterns as is illustrated by the hair-catching openings **156*a*-156*g* in the alternative examples of sections of a stationary cutter 152 shown in FIG. 6**.

Figure 9:
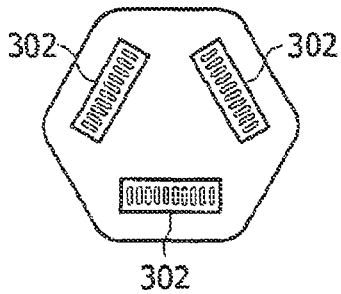
Figure 10:
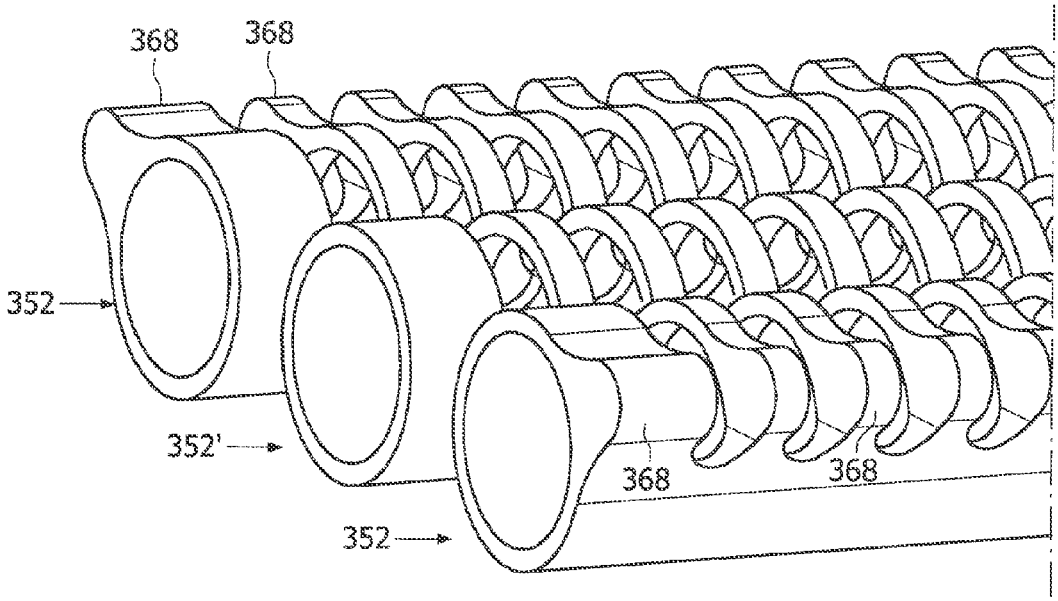
FIGS. 10 and 11 are enlarged perspective views of other examples of a possible configuration of cutter assemblies.

As is illustrated by FIGS. 7-10, a hair-clipping device according to the invention may also be equipped with main hair-clipping means of a type similar to the one described above in connection with the additional hair-clipping means. In such a case more than one set of stationary and movable cutter members can be provided. In the example shown in FIG. 7, a plurality of stationary cutter members 202 is arranged side by side in an arrangement defining a curved plane. Such an arrangement is advantageous for effectively shaving concave skin areas 220. In the example shown in FIG. 8, four stationary cutters 252 are arranged two-by-two in-line along crossing lines. Such an arrangement allows shaving a skin portion quickly by moving over the skin portions in various directions without having to rotate the hair-clipping device accordingly. Similar advantages are achieved with another embodiment as shown in FIG. 9 in which the stationary cutter members 302 are oriented in different directions, according to this example along lines forming sides of a equilateral triangle. In FIG. 10 an arrangement of stationary cutter members 352, 352' is shown, of which only outer ones are provided with hair-catching and skin-stretching ears 368. In such an arrangement, the number of stationary cutting members is larger than the number of rows of ears, so that apart from the cutting members adapted for catching longer hairs and stretching the skin, also cutting members dedicated for close shaving are provided.

Figure 11:
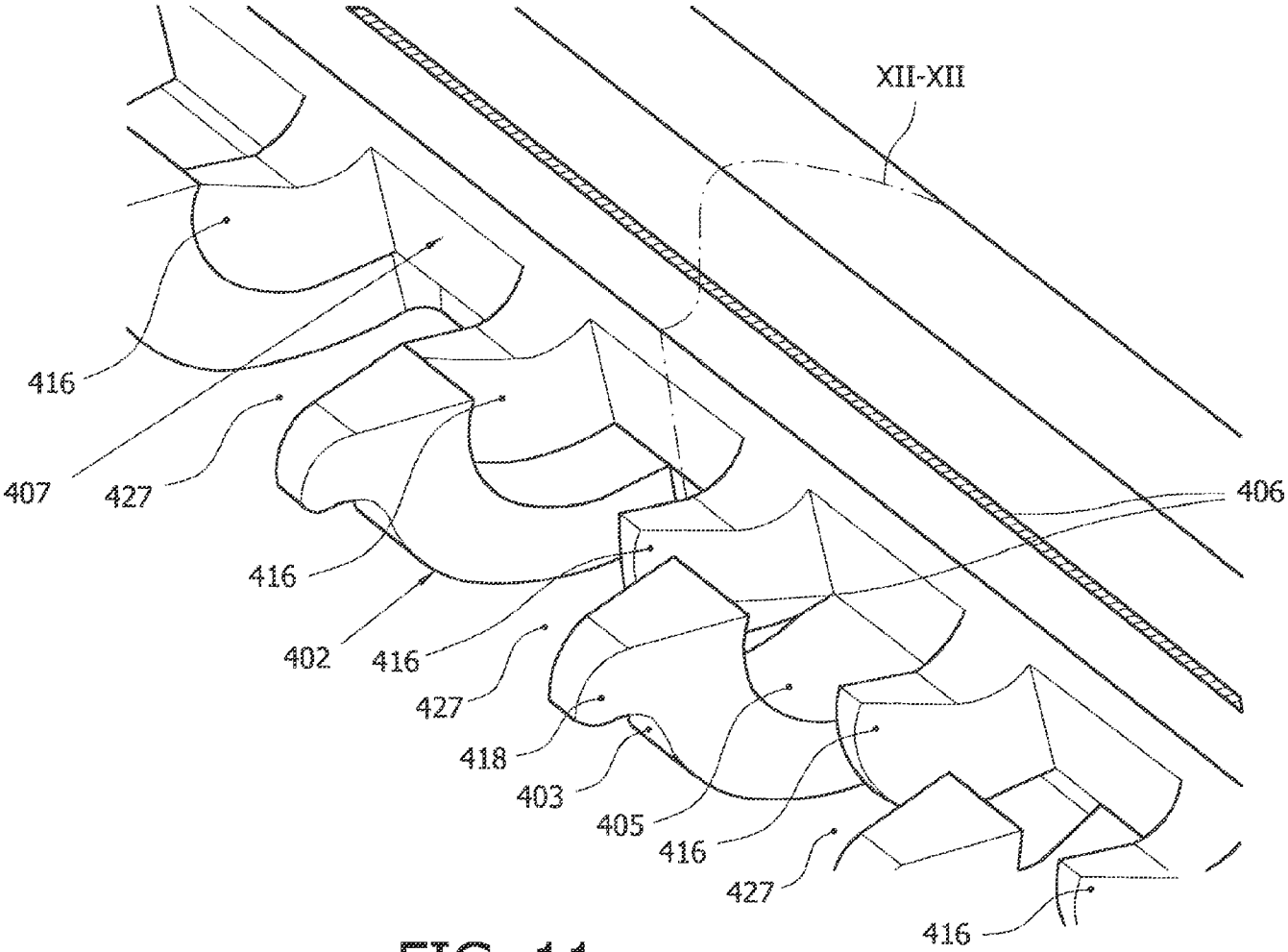
Figure 12:
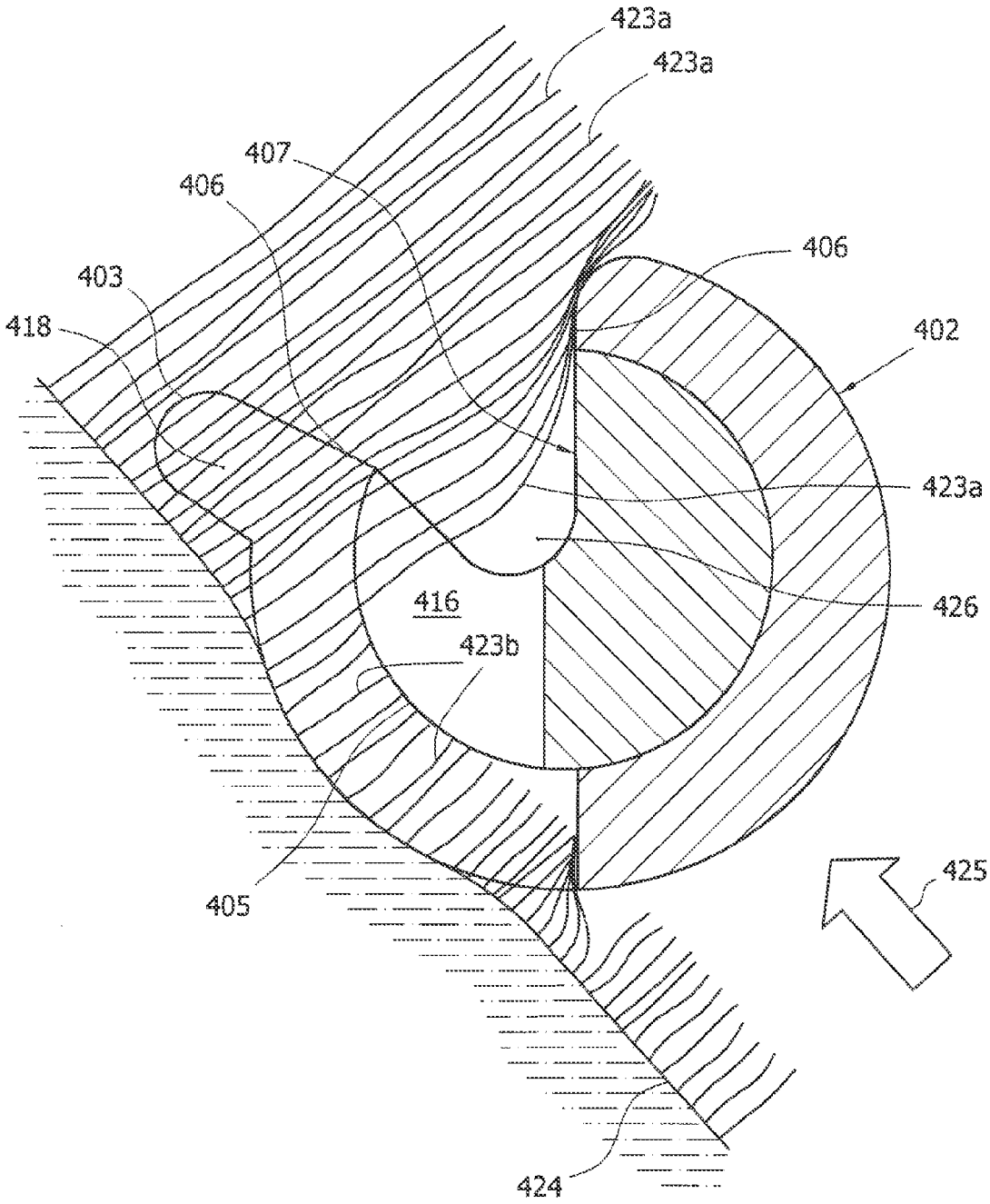
FIG. 12 shows in a cross-sectional view the operation of a cutter similar to that shown in FIG. 11 and used as additional hair-clipping means.

As is illustrated by FIGS. 11 and 12, the additional hair-clipping means may also have a hair-catching opening 406 that has a length in longitudinal direction of the cutter members 402, 407 that covers a plurality of the cutters 416. Such hair-catching opening designs are particularly suitable for efficiently trimming long hairs **423*a* to hairs 423*b* having shorter remaining length measured from the skin 424 (only some of the hairs are designated by reference numerals), with little risk of the hair-clipping device becoming stuck due to excessive amounts of hair being caught between the cutting members. In use the hair-clipping device is moved in the direction indicated by arrow 425 while in contact with the skin 424 with the ears 418 leading and close to or in contact with the skin 424. As is shown in FIG. 12, in the area of where the opening covers a plurality of cutters 416, shearing action for cutting the hairs is absent over a section of the circumference of the movable cutter member 407. This allows at least most of the longer hairs 423*a* to easily reach a segment of the circumference of the movable cutter member 407 where the shearing action between the stationary cutter member 402 and the movable cutter member 407 causes the hairs to be cut and allows most of the long hairs 423*a* to be cut only once, which reduces the resistance encountered by the movable cutter member 407 during quick trimming. To further facilitate the entry of long hairs, the circumference of the cutters 416 include recesses 426 forming a continuous, open area with the opening 406. To reduce the length of the sections of the cutter members where entry of long hairs between the cutting edges is impaired, the number of hair-catching openings is preferably small. According to the present example, a single hair-catching opening 406 extends from the outer surface 403 to the inner surface 405. To further reduce the length of the sections of the cutter members where entry of long hairs between the cutting edges is impaired, the hair-catching opening 406 of the stationary cutter member 402 or of at least one of the stationary cutter members 402 preferably covers substantially the chamber length of that stationary cutter member 402 (preferably at least about 80% and more preferably at least about 90% of the length). A particularly effective design for trimming the hair 423***a* is obtained if, as in the present example, the hair-catching opening 406 of the stationary cutter member 402 is in the form of a slit extending in the longitudinal direction of the stationary cutter member 402 and has a plurality of bays 427 projecting circumferentially from the slit, the cutting edges of the stationary cutter member 402 extending along said bays 427.

Figure 14A:
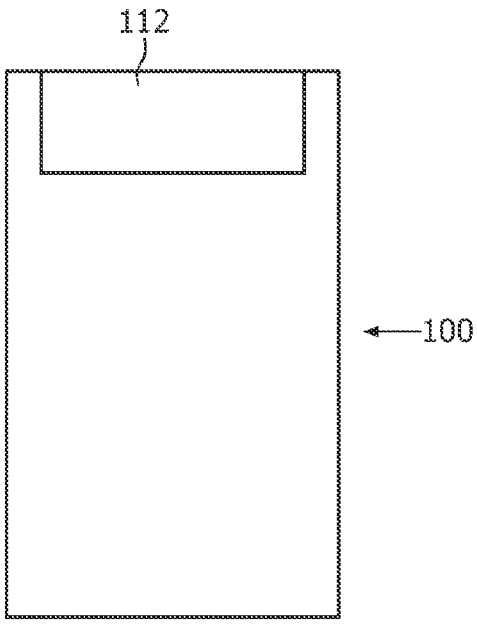
FIGS. 14A to 14D show different views of a first practical embodiment of a shaver in accordance with the invention.
Figure 14B:
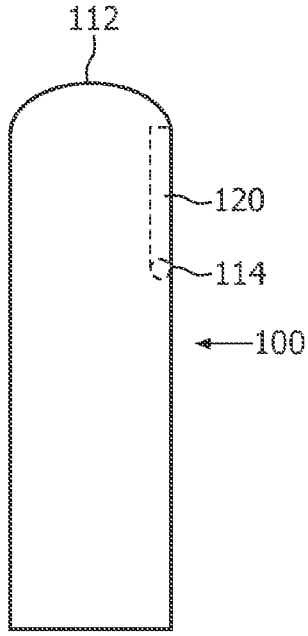
Figure 14C:
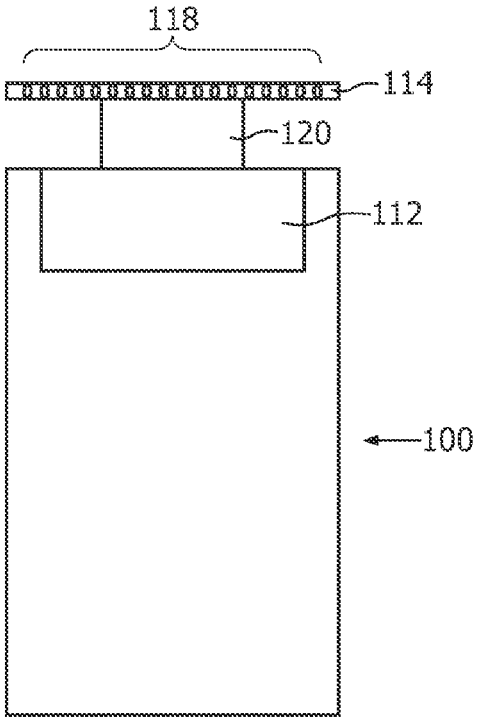
Figure 14D:
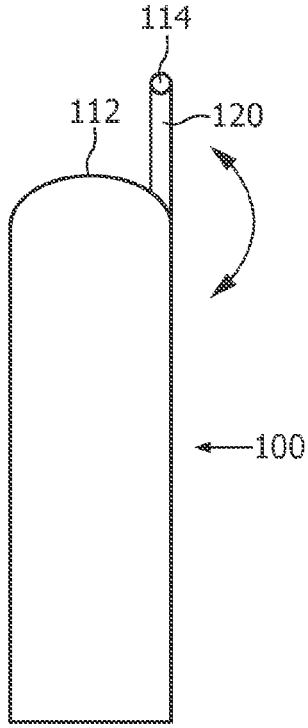

FIGS. 14A to 14D show different views of a first practical embodiment of a shaver 100 in accordance with the invention. The shaver 100 comprises main hair-clipping means 112 with rotating cutting elements and additional hair-clipping means 114 supported by supporting means 120. With this embodiment supporting means 120 and the active hair-clipping portion extending over the longitudinal dimension 118 comprise a T-configuration such that the additional hair-clipping means comprise two free end portions that can, for example, be easily inserted into the nose to remove nose hair. FIGS. 14A and 14B show the additional hair-clipping means 114 in a storage position while FIGS. 14C and 14D show the additional hair-clipping means 114 in working position. As indicated by the arrow in FIG. 14D, the change between the storage and the working position is effected by a pivoting movement.

Figure 15A:
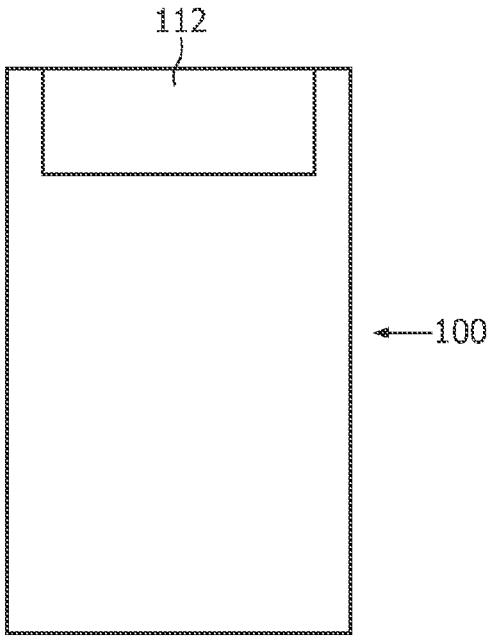
FIGS. 15A to 15D show different views of a second practical embodiment of a shaver in accordance with the invention.
Figure 15B:
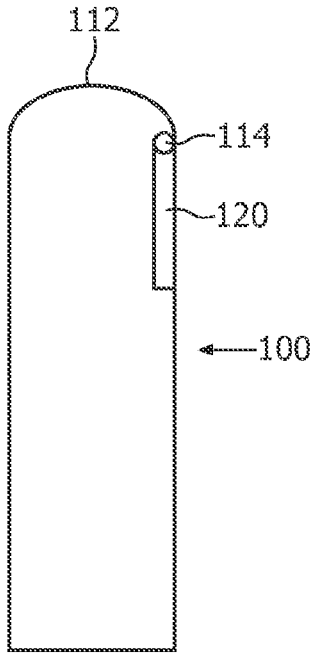
Figure 15C:
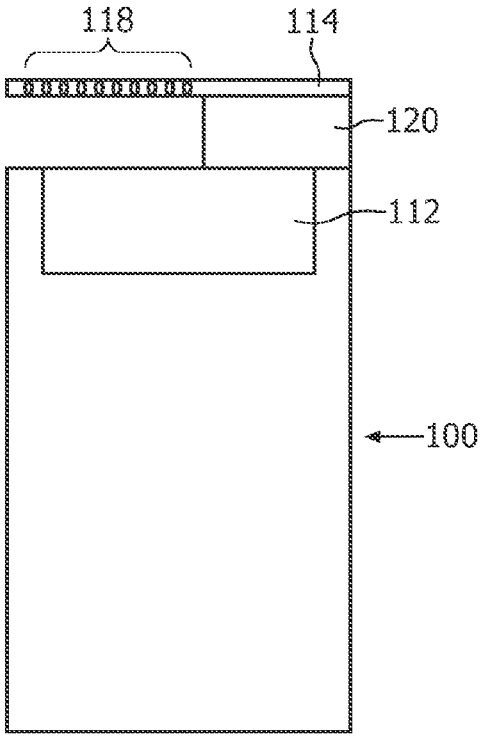
Figure 15D:
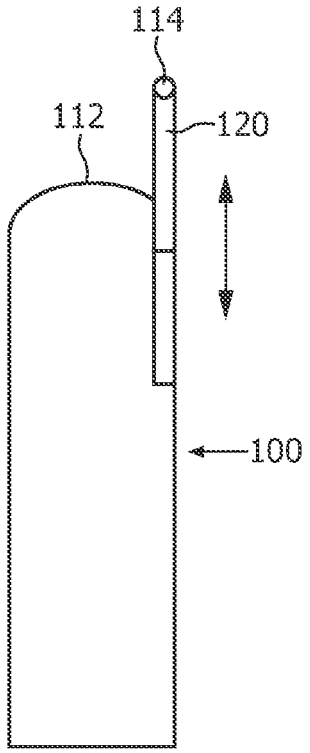

FIGS. 15A to 15D show different views of a second practical embodiment of a shaver 100 in accordance with the invention. Again, the shaver 100 comprises main hair-clipping means 112 with rotating cutting elements and additional hair-clipping means 114 supported by supporting means 120. With this embodiment supporting means 120 and the active hair-clipping portion extending over the longitudinal dimension 118 in general comprise an L-configuration. However, the arrangement is chosen such that the supporting means 120 do not extend over the longitudinal dimension 118 in which the active hair-clipping portion is provided. With this embodiment the additional hair-clipping means comprise one long free end portion that can, for example, be easily inserted into the nose to remove nose hair. FIGS. 15A and 15B show the additional hair-clipping means 114 in a storage position while FIGS. 15C und 15D show the additional hair-clipping means 114 in working position. As indicated by the arrow in FIG. 15D, the change between the storage and the working position in this case is effected by a sliding movement. Although not shown, it is also possible that the longitudinal dimension 118 at least in one working position extends vertical, i.e. perpendicular to the direction shown in the drawings, and in the same direction like the supporting means 120.

From the foregoing, it will be clear to the skilled person, that within the framework of invention as set forth in the claims also many variations other than the examples described above are conceivable.

For example, the tube trimmer described above as one possibility for realizing the additional hair-clipping means is very preferred, but the invention is not limited to this type of additional hair-clipping means. In general, all types of additional hair-clipping means, for example conventional hair trimming means, can be used as long as they provide at least one free end portion that can be easily inserted, for example, into the nose to remove nose hair.

Furthermore, the hair catching openings need not open in a direction perpendicular to a plane defined by a number of side-by-side arranged stationary cutter members, but may also open in a direction more or less parallel to such a plane for effectively catching long hair.

The chamber in the stationary cutter member need not be straight, but may also be curved if the movable cutter member or cutter members in the chamber is respectively are also curved and/or sufficiently flexible.

Also, the movement of the movable cutter member in the stationary cutter member need not be reciprocating in longitudinal direction, but may also be or include a rotary movement, for instance about a center line of the chamber in which the movable cutter member is fitted.

Finally, it is to be noted that equivalents and modifications not described above may also be employed without departing from the scope of the invention, which is defined in the accompanying claims.

The invention claimed is:

1. A hair-clipping device comprising:

a main body;

a main hair-clipping unit supported by the main body; and an additional hair-clipping unit having an active hair-clipping portion extending over a longitudinal dimension and being supported by a supporting unit;

wherein the supporting unit at least in one predetermined working position of the active hair-clipping portion does not extend or extends only over a part of the longitudinal dimension without extending over a remaining part of the longitudinal dimension, wherein the active hair-clipping portion and the supporting unit at least in the predetermined working position comprise an L-configuration, the active hair-clipping portion extending in one direction away from the supporting unit along the longitudinal dimension without extending in an opposite direction opposite to the one direction away from the supporting unit along the longitudinal dimension, wherein at least the active hair-clipping portion is movable between the at least one working position and a storage position, and wherein moving the active hair-clipping portion between the at least one working position and the storage position comprises a sliding movement.

2. The hair-clipping device according to claim 1, wherein the supporting unit comprises a transmission unit for coupling the additional hair-clipping unit at least in the predetermined working position to a motor accommodated in the main body.

3. The hair-clipping device according to claim 1, wherein the additional hair-clipping unit comprises:

a stationary cutter member having an outer surface, a chamber bounded by an inner surface, and at least one hair-catching opening extending from the outer surface to the inner surface;

at least one movable cutter member comprising at least one cutting edge, the movable cutter member fitting in the chamber with a free, close fit;

wherein a drive is coupled to the movable cutter member for driving movement of the movable cutter member relative to the stationary cutter member.

4. The hair-clipping device according to claim 3, wherein the at least one movable cutter member includes a carrier oriented in a longitudinal direction of the movable cutter member, cutting edges being provided on cutters projecting radially from the carrier.

5. The hair-clipping device according to claim 4, wherein the at least one movable cutter member includes a rod section with recesses, the cutting edges being integrally formed with the carrier by edges of the recesses.

6. The hair-clipping device according to claim 3, wherein the at least one movable cutter member has a largest cross-sectional size smaller than 10 mm.

7. The hair-clipping device according to claim 3, wherein the chamber has a circular cross-section.

8. The hair-clipping device according to claim 3, wherein the at least one movable cutting member fits in the chamber with a clearance smaller than 50 μm.

* * * * *